United States Patent [19]

Gowdy

[11] 4,277,900

[45] Jul. 14, 1981

[54] IRON STEAM CHAMBER CONSTRUCTION

[75] Inventor: Harold W. Gowdy, Asheboro, N.C.

[73] Assignee: General Electric Company, New York, N.Y.

[21] Appl. No.: 137,122

[22] Filed: Apr. 4, 1980

[51] Int. Cl.[3] ..... D06F 75/06

[52] U.S. Cl. ..... 38/77.83

[58] Field of Search ..... 38/77.83, 77.9, 88, 38/89, 77.8–77.82

[56] References Cited

U.S. PATENT DOCUMENTS

| | | | |
|---|---|---|---|
| 2,967,365 | 1/1961 | Extale et al. | 38/77.83 |
| 3,703,777 | 11/1972 | Knapp | 38/77.83 |
| 3,747,241 | 7/1973 | Davidson | 38/77.83 |
| 4,115,935 | 9/1978 | Toft | 38/88 |
| 4,130,954 | 12/1978 | Walker | 38/77.83 |

FOREIGN PATENT DOCUMENTS

| | | | |
|---|---|---|---|
| 554795 | 2/1957 | Belgium | 38/77.83 |

*Primary Examiner*—Louis Rimrodt

*Attorney, Agent, or Firm*—John F. Cullen; George R. Powers; Leonard J. Platt

[57] ABSTRACT

In a steam iron with a handle, water tank, a steam generating soleplate with ports and a continuous vertical wall enclosing and spaced from an elongated heating element, with steam directing ribs within the wall and a coverplate secured to upstanding bosses to form a steam generating and distributing chamber, an improvement is provided in the chamber construction wherein a plurality of the bosses are disposed along the heating element, preferably as part of the directing ribs, with the bosses being spaced inwardly of the vertical wall to form a straight passage along the wall. The wall has a continuous lip along its upper outer edge forming a cup-like niche for the coverplate with the lip extending well above the coverplate. Generally, the bosses protrude through the coverplate and are staked thereto. A high temperature adhesive sealant is disposed along and over the coverplate periphery at the lip. Preferably, a clearance is provided between the coverplate and the lip so that the sealant flows in the clearance to completely anchor the coverplate to the soleplate at the lip which also prevents overflowing and at the inward bosses with all sealant entirely external to the generating and distributing chamber.

6 Claims, 4 Drawing Figures

IRON STEAM CHAMBER CONSTRUCTION

BACKGROUND OF THE INVENTION

1. Field of the Invention

The invention herein pertains to a conventional steam iron with an improved steam generating and distributing chamber formed by structural improvements to the chamber cover/soleplate securement for better steam control and a thinner coverplate.

2. Description of the Prior Art

In order to use water for steam or spray or both, a water tank is provided in the iron shell above the soleplate and under the handle portion and a valve drips water into a generator in the soleplate where it is flashed into steam and directed out ports in the soleplate to steam the article. Such irons have incorporated self-clean features as in U.S. Pat. No. 3,747,241 of common assignment. Also, newer molded plastic irons, have substantially simplified iron design by eliminating many common metallic parts. Such irons are easier to make, cheaper, and lighter and the small iron plastic technology as in U.S. Pat. No. 4,115,935 has been extended to standard full size irons of the type shown in U. S. Pat. No. 4,130,954 both of common assignment. Generally, a steam generating and distributing chamber is cast in the soleplate and a cast coverplate over the soleplate separates the chamber from the other internal iron parts so water drips into the steam generating chamber and is flashed into steam and is directed through various tortuous passages to eventually exit the soleplate ports. Such internal chamber must be scrupulously clean in order to prevent the phenomenon known as dri-filming or the tendency of water in the chamber to ball and not wet the surfaces to be flashed into steam. It is like dropping water into a hot frying pan—it balls and rolls and bounces around—not desired in an iron. This is prevented by carefully cleaning and spraying the internal surfaces of the iron with a coating such as disclosed in U.S. Pat. No. 2,967,365 of common assignment. In prior art irons, coverplates are cast for stiff construction. It is customary to use a sealing compound on the inner mating edges where the coverplate meets the ribs or walls of the steam distributing system and then to clamp the coverplate tightly to the soleplate by bolting it down. This squeezes out the compound inside the distribution system and can create problems of dri-filming as well as difficult seal problems. In the lightweight irons it is desired to avoid a cast coverplate, to make it thin and still effectively seal the steam generating and distribution chamber. A light stamped part does not have the stiff body of cast coverplates and the usual outboard securement as by bolting will not effectively keep the coverplate flat and sealed against the internal ribs. The present invention is directed to an improvement in the chamber construction such that a light and thin coverplate is used and is effectively and adhesively sealed outside of the chamber. Such improvement satisfactorily anchors the coverplate to the soleplate so that the chamber is sealed off entirely externally to avoid dri-film problems.

SUMMARY OF THE INVENTION

Briefly described, the invention is directed to a steam iron with a handle, water tank, and steam generating soleplate with ports and a continuous vertical wall enclosing and spaced from an elongated heating element and having steam directing ribs within the wall and a coverplate secured to the top of the wall to upstanding bosses forming a steam generating and distributing chamber between the coverplate and soleplate. An improvement is provided by having the conventional bosses along the heating element as part of the distributing or directing ribs and disposed inwardly of the wall to form a straight passage along the wall within the chamber. The wall is provided with a continuous lip along its upper outer edge to form a cup-like niche for the coverplate to fit therein preferably with a clearance between the plate and the lip. The lip extends well above the coverplate and the bosses preferably protrude through and above the coverplate and are preferably staked thereto. A high temperature adhesive sealant is provided over the coverplate periphery at the lip flowing into the clearance to completely anchor the coverplate to the soleplate at the lip and at the bosses entirely external to the generating and distributing chamber. Also, the sealant may be applied over the bosses. This provides a solid undistorted thin coverplate permanently sealed to the soleplate outside for improved channeling of the steam in an environment that is entirely free of foreign substances. Thus, the main object of the invention is to provide an improved steam generating and distributing chamber construction completely free of foreign substances and permanently sealed entirely externally while permitting undistorted and close fitting abutment with the internal steam directing ribs and walls.

DESCRIPTION OF THE PREFERRED EMBODIMENT

Figure 1:
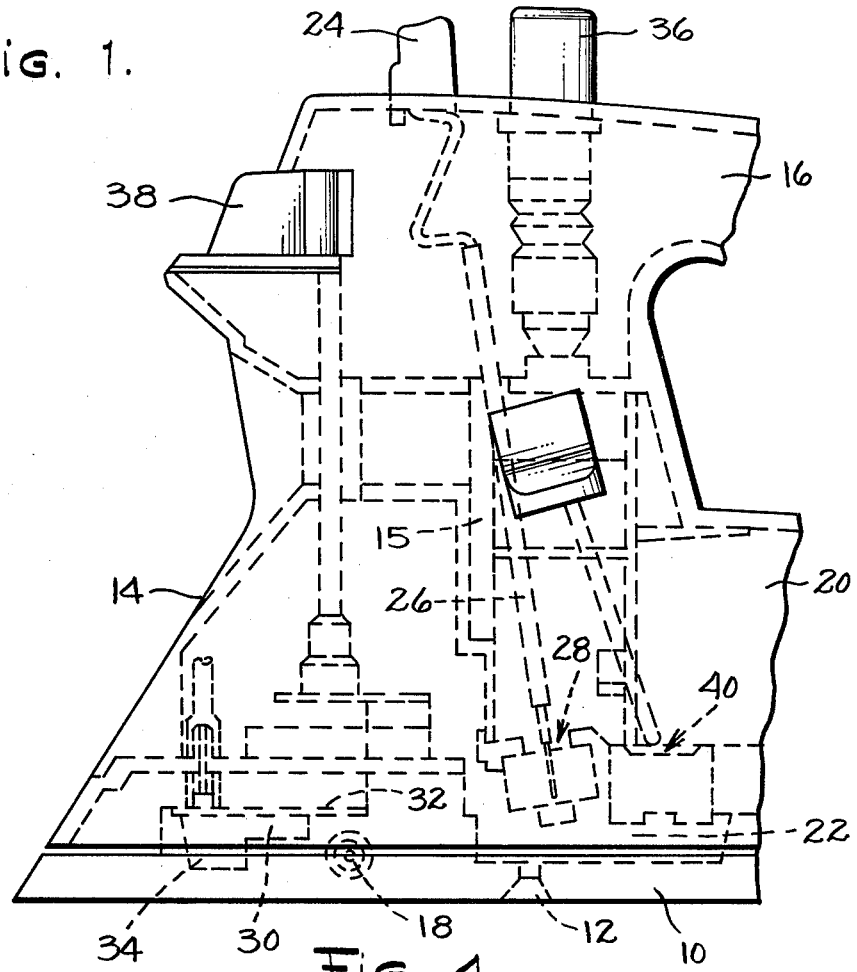
FIG. 1 is a partial elevational view showing general parts of an iron with the internals dotted.

Referring to FIG. 1, there is shown an electric steam iron generally of the self-cleaning variety of the type shown in U.S. Pat. No. 3,747,241 supra. As such, the iron includes a soleplate 10 with a plurality of steam ports 12 and an outer shell 14 which may be plastic with a forward riser portion 15 which, with shell 14, is connected to extend in the handle 16 in known fashion. The soleplate 10 conveniently may be cast from aluminum with electric heating element 18 cast in position and disposed so uniform heat distribution is provided when the iron is plugged in and activated.

The iron includes means for generating steam by providing water tank 20 that is an inner part of preferably single plastic housing shell 14 secured to soleplate 10 in a known manner. For steam, soleplate 10 has a steam generator 22 into which, under control of button 24 and guided valve stem 26 movable between an on/-off position, water controllably drips from tank 20 onto hot soleplate 10 through metering water valve 28 of the type in U.S. Pat. No. 3,496,661 of common assignment, the resulting steam being distributed through passages 30 under coverplate 32 and out ports 12 onto the fabric being ironed. In the embodiment shown, an additional surge may be provided by injecting water into a separate forward generator 34 by control button 36 and control 38 thermostatically sets the soleplate heat. All the structure described is generally well known. One of the main features in the self-cleaning iron is provision for suddenly and completely dumping tank 20 onto the hot soleplate through a substantially large opening that preferably, although not necessarily, is spaced and separate from the usual water valve 28. Controlling this large opening, a dumper valve 40 is disposed in the bottom of the water tank to quickly empty the tank onto the soleplate where the combination of hot water and steam suddenly created forcefully purges or cleans the internal passages and distribution system, tank, and ports 12 of lint and internal deposits. A dump valve structure is shown in U.S. Pat. No. 4,130,954 supra.

Figure 4:
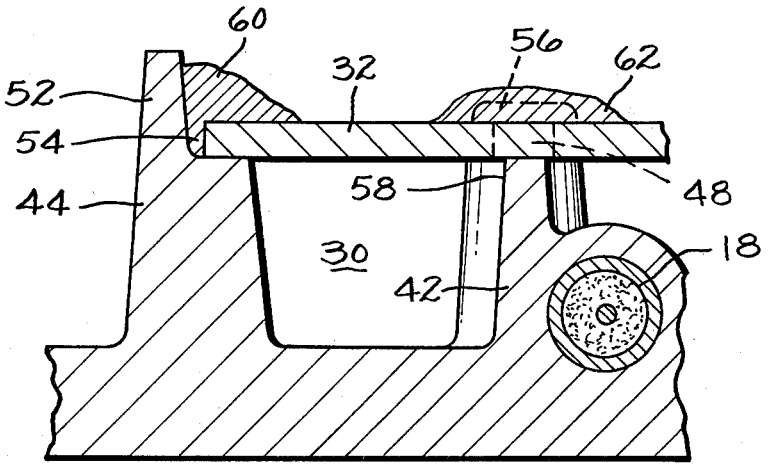
FIG. 4 is a partial enlarged cross-section on line 4—4 of FIG. 2 illustrating the sealing.
Figure 2:
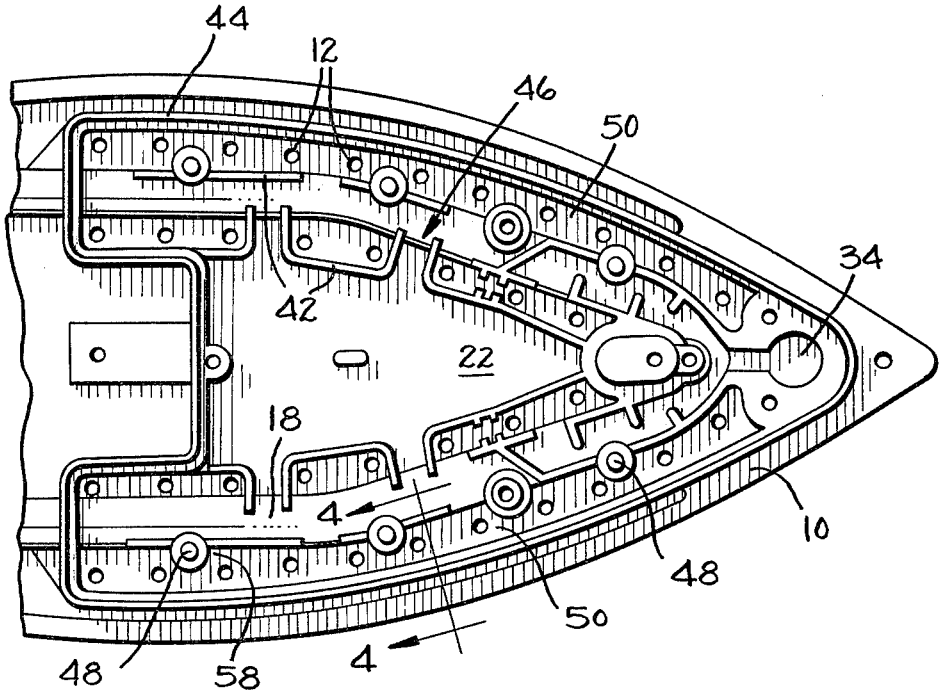
FIG. 2 is a partial plan view of the steam generating and distributing area of a soleplate.
Figure 3:
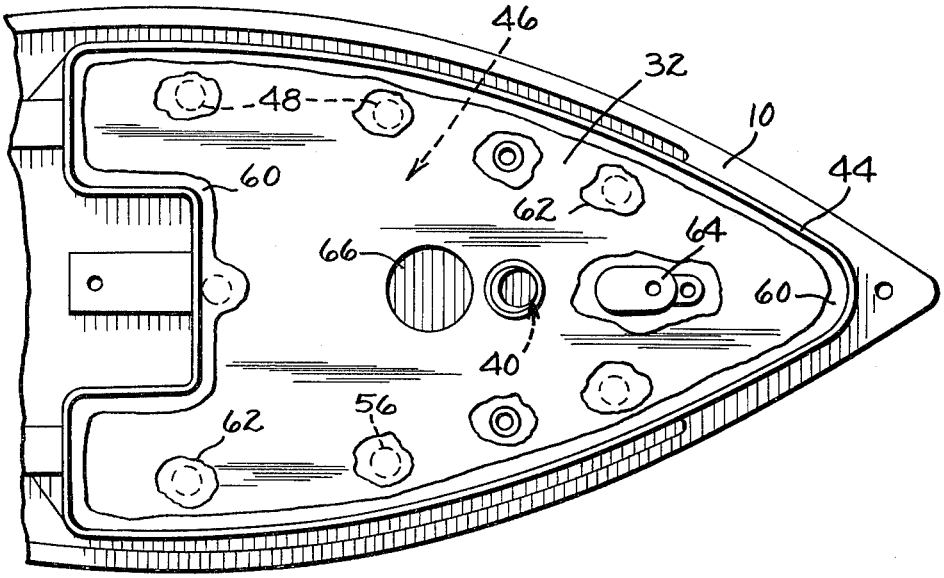
FIG. 3 is a view of the soleplate of FIG. 2 with the coverplate applied according to the invention.

In accordance with the invention, in the above conventional type of iron, coverplate 32 normally is a cast aluminum plate coated with a suitable sealant and then bolted to the soleplate much like a gasket between the coverplate and soleplate. This sealant material introduces undesireable side effects one being the "dri-filming" characteristic noted above. Additionally, the heavy cast coverplate seals without distorting. A thin coverplate with normal peripheral bolting does not firmly seat against the internal ribbed directing structure, the peripheral bolting tending to distort or bell out the center of the coverplate. In keeping with the invention, as seen in FIG. 3, a multitude of upstanding steam directing ribs 42 may take any form depending on the iron and are designed to control the steam generated at 22 to direct it for maximum heat transfer and subsequently out steam ports 12. The particular arrangement may take many varieties and is merely illustrative as shown. In order to define the steam system, a continuous vertical wall 44 of any suitable shape forms a generating and distributing chamber 46 consisting of the volume within the vertical wall 44. This entire chamber 46 is enclosed at its top by coverplate 32 to form the steam generating and distributing chamber as is conventional. For use with a much thinner stamped sheet metal coverplate 32, of FIGS. 3 and 4, it is necessary to better support the coverplate to prevent distortion. To this end, any suitable means to secure the coverplate may be used. Preferably, a series of upstanding bosses 48 cast as part of the soleplate, are disposed along the heater 18 but are spaced inwardly of wall 44 for more central anchoring of the coverplate and to form a substantially straight passage 50 along the length of wall 44 for the flow of steam close to the heater 18 for better control of the steam to soleplate ports 12. Normally, the bosses, are located on the outer periphery adjacent wall 44. Spacing the bosses inwardly provides more inboard anchoring of the coverplate as well as better control of the steam direction to the outer soleplate ports 12. Thus, there is improved channeling of the steam while holding the thin coverplate more centrally and securely for sealing against the tops of directing ribs 42. For receiving the coverplate 32, continuous vertical wall 44 is provided with an upstanding lip 52, as seen in FIG. 4, extending along the upper and outer edge of wall 44 to form a cup-like niche for the coverplate. This niche is sized so that a clearance 54 is provided between the coverplate periphery and the extending lip for a purpose to be described. Preferably, the bosses 48 protrude above the coverplate to stake it in position as shown at 56. This tightly seals the coverplate against the tops of ribs 42 and against the upper surface of outer wall 44 as seen in FIG. 4, the inward spacing of the bosses 48 holding the coverplate better against ribs 42 without distortion of the coverplate 50 so steam cannot flow over the tops of ribs 42 thus providing better steam control. Better heat exchange and directional control is obtained by casting the bosses 48 as part of a directing rib as shown at 58.

To further completely seal the inner chamber 46, a high temperature adhesive sealant 60 is disposed completely around and over the coverplate periphery at the lip as seen in FIGS. 3 and 4. Any suitable high temperature adhesive sealant such as RTV (room temperature vulcanizing rubber) will do. With the clearance 54, the sealant, which is put on in a semi-liquid state, will flow into and fill the clearance with a large area of adhesive directly agaist the inner wall of lip 52 as well as the upper periphery of coverplate 32. Additionally, the sealant may be dabbed over the staked tops of the bosses as at 62 and around the thermostat boss 64. This non-distorting arrangement of the thin coverplate with its adhesive sealant anchoring against the high lip 52, which also is a dam to pevent liquid overflowing wall 44, and then positioning the internal bosses 48 well inwardly of the periphery, allows coverplate 32 to seal at the tops of internal ribs 42 completely across the coverplate forcing steam from generator 22 to travel a superheated path to the ports 12 without any internal sealant on the top of the ribs 42 thus avoiding the problems of dri-filming by the presence of sealant in the chamber 46. Water valve 28 fits in coverplate opening 66 to supply water. The peripheral sealant 60 restrains the coverplate edge from lifting because of its spacing from staked bosses 48 and the large adhesive contact along the inner surface of lip 52 forms a seal against any steam leakage. Thus, the boss location and the adhesive on the outer surface permits the use of a cheaper and thinner coverplate 32 effectively anchored to perform its function by distortion-free securement and completely sealed external to chamber 46.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a steam iron with a handle, water tank, and steam generating soleplate with ports and continuous vertical wall enclosing and spaced from an elongated heating element, steam directing ribs within said wall and a coverplate secured to upstanding bosses to form a steam generating and distributing chamber an improvement in said chamber comprising, said bosses disposed along but spaced inwardly of said wall forming a straight passage along said wall, a continuous lip along the wall upper outer edge forming a cup-like niche for the coverplate, said lip extending above the coverplate, and a high temperature adhesive sealant along and covering the coverplate periphery at said lip, whereby the coverplate is anchored to the soleplate at said lip and said inward bosses entirely external to the generating and distributing chamber.

2. Apparatus as described in claim 1 wherein said sealant also covers each inwardly disposed boss.

3. Apparatus as described in claim 2 wherein a clearance is provided between the coverplate periphery and extending lip and said sealant is disposed in the clearance to anchor the coverplate edge along said lip.

4. Apparatus as described in claim 3 wherein said bosses protrude through and above said coverplate and are staked thereto.

5. Apparatus as described in claim 4 wherein a plurality of said bosses are disposed along said heating element adjacent thereto.

6. Apparatus as described in claim 5 wherein said bosses adjacent said heating element are formed in directing ribs along said element.

* * * * *